US007260912B2

(12) United States Patent
Liu

(10) Patent No.: US 7,260,912 B2
(45) Date of Patent: Aug. 28, 2007

(54) GUN BARREL AND TRIGGER FLASHLIGHT AND/OR LASER MOUNT STRUCTURE

(76) Inventor: Philip Liu, 22F Alley 97 Lane 110 Hu-Cien St., Hsi-Chih City, Taipei Hsien (TW)

( * ) Notice: Subject to any disclaimer, the term of this patent is extended or adjusted under 35 U.S.C. 154(b) by 357 days.

(21) Appl. No.: 11/117,537

(22) Filed: Apr. 29, 2005

(65) Prior Publication Data

US 2006/0242882 A1 Nov. 2, 2006

(51) Int. Cl.
*F41G 1/38* (2006.01)

(52) U.S. Cl. ..... 42/127; 42/124; 42/125; 42/126; 42/128; 42/148

(58) Field of Classification Search ..... 42/124–128, 42/148
See application file for complete search history.

(56) References Cited

U.S. PATENT DOCUMENTS 5,276,988 A * 1/1994 Swan ..... 42/127
5,570,529 A * 11/1996 Amelino ..... 42/124
6,185,854 B1 2/2001 Solinsky et al.
6,449,893 B2 * 9/2002 Spinner ..... 42/127
6,678,988 B1 * 1/2004 Poff, Jr. ..... 42/147
7,013,593 B2 * 3/2006 Pettersson et al. ..... 42/148
7,107,716 B1 * 9/2006 Liao ..... 42/108
2004/0148842 A1 * 8/2004 Aalto et al. ..... 42/127

* cited by examiner

*Primary Examiner*—Troy Chambers
(74) *Attorney, Agent, or Firm*—Rosenberg, Klein & Lee

(57) ABSTRACT

A tactical flashlight and/or laser mount structure has a chassis, two control buttons, an elastic means, a movable tenon and a mounting mortise. The chassis is fixed on the top of the tactical flashlight and/or laser for engaging the chassis with the gun separately. Each of the control buttons includes a pressing portion and a lift portion, the two control buttons are outward- and inward-movably disposed on the chassis, the elastic means is disposed between the two control buttons, a movable tenon is upward and downward movably disposed on the chassis and formed with two oblique notches, the lift portion of two control buttons joint to the oblique notches, and the mounting mortise is fixed on the gun.

13 Claims, 7 Drawing Sheets

GUN BARREL AND TRIGGER FLASHLIGHT AND/OR LASER MOUNT STRUCTURE

BACKGROUND OF THE INVENTION

1. Field of the Invention

The present invention relates to a gun barrel and trigger flashlight, and/or laser mount structure, and in particular to a mount structure by which flashlight, and/or laser can be quickly mounted on or removed from a gun.

2. Description of Related Art

Conventional tactical flashlight and/or laser are mounted on a gun to improve aim. An appropriate mount is necessary to mount the scope on the shield or barrel of the gun.

Referring to FIG. 1, the conventional flashlight and/or laser 7 is mounted on a gun 9 via a mount 8. The mount 8 is formed with two U-shape screws 81 and four nuts 82. One of the U-shape screws 81 is disposed higher than the other so that both can match the shield 91 of the gun 9. The ends of the U-shape screws 81 are inserted into four holes 71 of the scope 7, of which the left holes 71 correspond to the right holes 71, and the ends of the U-shape screws 81 are screwed to the nuts 82 so as to mount the flashlight and/or laser 7 to the shield 91 of the gun 9.

The above-mentioned conventional mount 8 of a tactical flashlight and/or laser uses the screws 81 and nuts 82 to mount the tactical flashlight and/or laser 7 onto the gun 9. Use of this type of mount structure is, however, wasteful of time and effort, and thus causes inconvenience during mounting or removal of the flashlight and/or laser. The flashlight and/or laser thus cannot be quickly mounted on or removed from a gun.

Further, with reference to FIG. 2, which is an illustration of a conventional tactical flashlight and laser combo 10 (e.g. U.S. Pat. No. 6,185,854 B1), the tactical flashlight and laser combo 10 is connected to the gun separately, a shaft 6 is disposed on the top of the tactical flashlight and laser combo 10, the shaft 6 corresponds to holes 64 at two sides of the top of the tactical flashlight and laser combo 10, two end portions 62 of the shaft 6 penetrate the two sides of the top of the tactical flashlight and laser combo 10, respectively, and a spring 70 is disposed under the shaft 6 for abutting the shaft 6 to generate an upward displacement so that the shaft 6 can be lifted and engaged with the corresponding groove of the gun for mounting the tactical flashlight and laser combo 10 to the gun.

However, while disassembling the tactical flashlight and laser combo 10 from the conventional mount of the gun described above, the user must press with great force on the end portions 62 of the shaft 6 to remove the shaft 6 from the corresponding groove of the gun, and such operation is inconvenient.

Given the above, the conventional fixing manner of gun tactical flashlight and laser combo still has inconvenience and defects in practice, which need to be improved.

SUMMARY OF THE INVENTION

The main objection of the present invention is directed to providing a gun barrel and trigger tactical flashlight and/or laser mount structure, whereby the tactical flashlight and/or laser is quickly mounted on and removed from the gun, and operation of the mount is simple and easy.

To achieve the above objection, the present invention provides a tactical flashlight and/or laser mount structure for mounting a scope on a gun. The mount structure comprises a chassis disposed on the tactical flashlight and/or laser and connected to the gun separately. Two control buttons, each having a lift portion, are outward- and inward-movably disposed on the chassis. An elastic means is disposed between the two control buttons. A movable tenon is upward- and downward-movably disposed on the chassis and is formed with two oblique notches. The lift portions of the control buttons selectively correspond to the oblique notches. The movable tenon is supported above the chassis by the least one spring. A mounting mortise is fixed on the gun, when the movable tenon is lifted and jointed to the mounting mortise for securing the tactical flashlight and/or laser to the gun.

The mount structure allows a tactical flashlight and/or laser to be rapidly mounted on or removed from a gun according to the present invention. Operation of the mount structure is simple and easy.

Now, the present invention will be described more specifically with reference to the following embodiments. It is to be noted that the following descriptions of preferred embodiments of this invention are presented herein for purpose of illustration and description only; it is not intended to be exhaustive or to be limited to the precise form disclosed.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
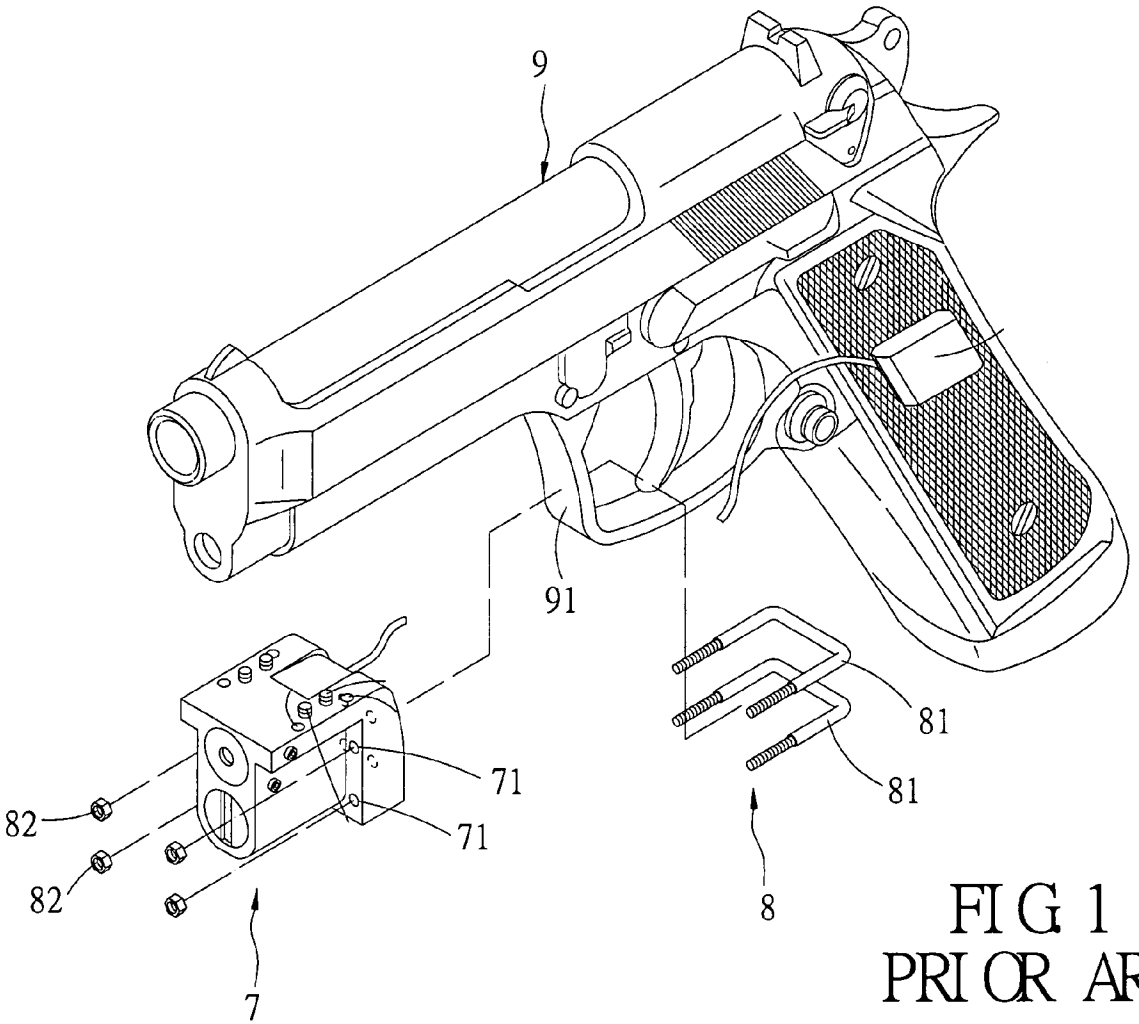
FIG 1 PRIOR ART
FIG. 1 is a three-dimensional diagram illustrating a conventional tactical flashlight and laser combo mount.
Figure 2:
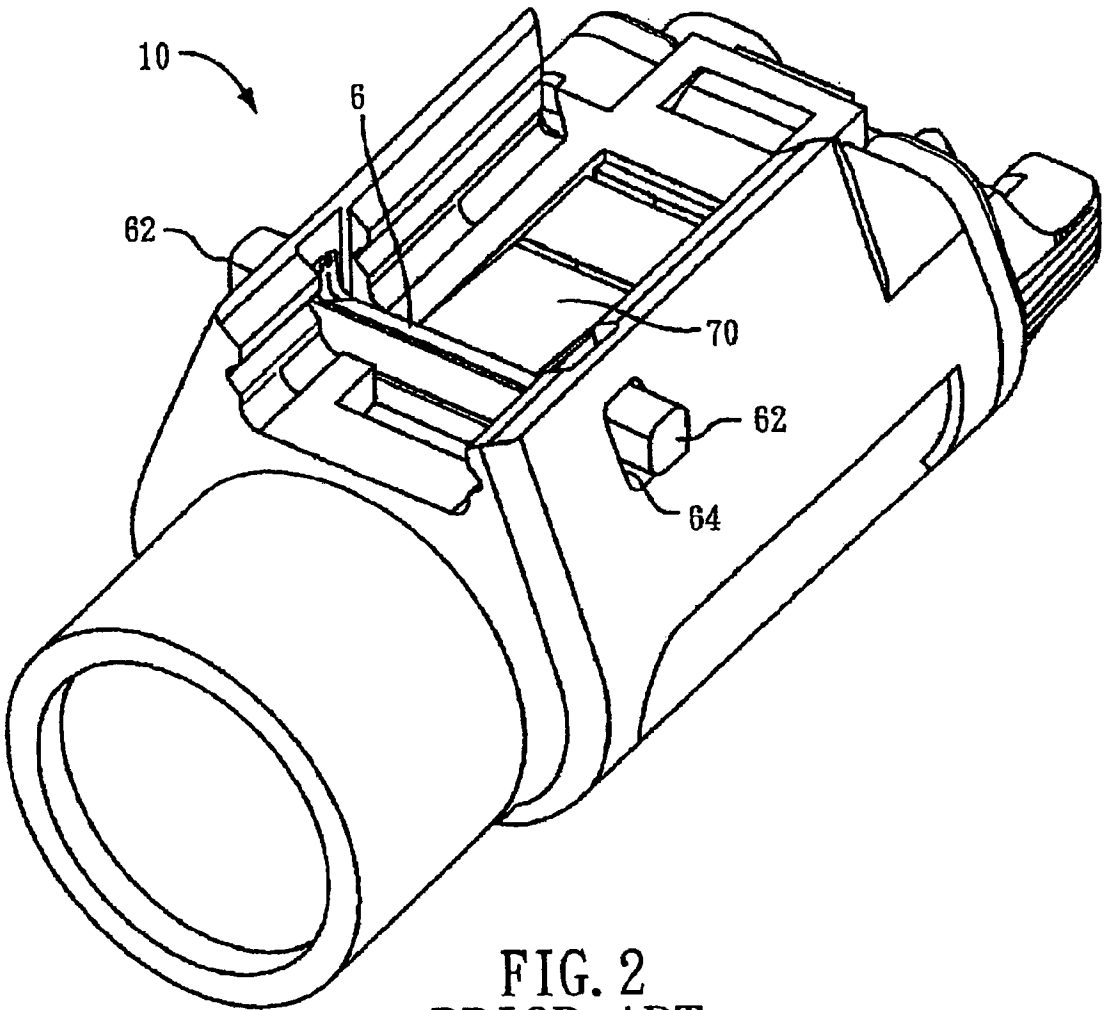
FIG. 2 PRIOR ART
FIG. 2 is a three-dimensional diagram illustrating another conventional tactical flashlight and laser combo scope mount.

Referring to FIGS. 3-6, the present invention provides a tactical flashlight and/or laser mount structure, and in particular to a mount structure 3 that can mount the tactical flashlight and/or laser 1 on the gun 2. The mount structure 3 is disposed between the tactical flashlight and/or laser 1 and gun 2. The mount structure 3 comprises a chassis 31, two control buttons 32, an elastic means 33 and a movable tenon 34. The chassis 31 is disposed on the top of the tactical flashlight and/or laser 1, the top of the chassis 31 is recessed with a space 311, and the top, front and rear ends of the space 311 are open for accommodating control buttons 32, elastic means 33 and movable tenon 34. A pair of first slideways 312 is disposed on two sides of the space 311. The chassis 31 uses the first slideways 312 to engage with a pair of second slide ways 35 corresponding thereto on the bottom of a barrel 21 of the gun 2. The pair of second slideways 35 is disposed along the vertical direction of the barrel 21 so that the tactical flashlight and/or laser 1 can connect to the barrel 21 of gun 2 separately by vertical engagement therewith. Another, each of two sides of the chassis 31 is disposed on a fixed portion device 36, comprising a fixed sleeve 361, a spring 362 and a fixed portion ball 363, the fixed sleeve 361 is fixed to two sides of the chassis 31 by a screwed or wedged connect, the spring 362 and the fixed portion ball 363 are disposed in the fixed sleeve 361, the spring 362 is touched to the fixed portion ball 363, to make the surface of the fixed portion ball 363 is elastically protruded to one side of the fixed sleeve 361, and the tactical flashlight and/or laser 1 is stably connect to the barrel 21 of the gun 2 by the fixed portion ball 363 of two fixed portion device 36 being elastically touched to the second slide ways 35 of the bottom of the barrel 21 of the gun 2. A first aperture 313 and a second aperture 314 are respectively disposed on each of two sides of the space 311. The apertures 313 and 314 laterally extend along the chassis 31 and go through to the outer wall of the chassis 31 for assembly of the control buttons 32 and movable tenon 34.

A pressing portion 321 is disposed on each of the control buttons 32. The inside of pressing portion 321 protrudes with a block-shape abutting portion 322 and a cylindrical lift portion 323. The two control buttons 32 use the pressing portion 321 to slide within two of the first apertures 313 of the chassis 31, so that the two control buttons 32 can move outward and inward. The abutting portions 322 and lift portions 323 of the two control buttons 32 extend into the space 311.

The elastic means 33 is a spring or other means with elasticity and is disposed in the space 311 of the chassis 31, two ends of the elastic means 33 abut against the abutting portions 322 of the two control buttons 32 for disposing the elastic means 33 between two control buttons 32. The elastic force from the elastic means 33 thus pushes the pressing portions 321 of the two control buttons 32 out of the chassis 31 so that the user can conveniently press the pressing portions 321 of two control buttons 32. The two control buttons 32 then move inward, and the elastic means 33 provides the force for moving the pressed control buttons 32 outward.

The bottom of the movable tenon 34 is supported in the space 311 of the chassis 31 by two springs 324. A sliding portion 343 is disposed on each of two sides of the movable tenon 34. The sliding portions 343 at the two sides of the movable tenon 34 are lower than the second apertures 314 of the chassis 31 so that the sliding portions 343 at the two sides of the movable tenon 34 can slide up and down within the second apertures 314 of the chassis 31. The movable tenon 34 can thus move up and down with respect to the top of the chassis 31. The movable tenon 34 is recessed with two oblique notches 341, the oblique notches 341 are oblique channels that its inside is rose to the outside, the lift portions 323 of the two control buttons 32 is corresponded to the oblique notches 341 of the movable tenon 34.

Figure 6:
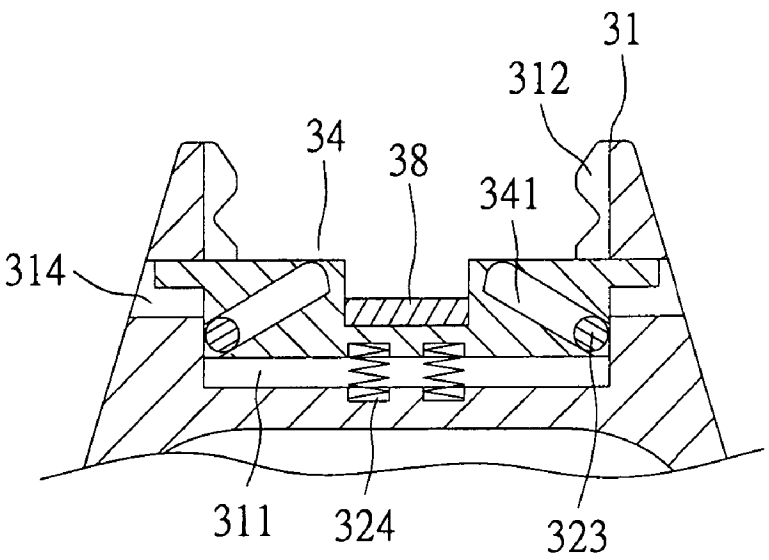
FIG. 6 is a schematic diagram illustrating an operating mode (1) of the tactical flashlight and/or laser of the present invention mounted on a gun.
Figure 8:
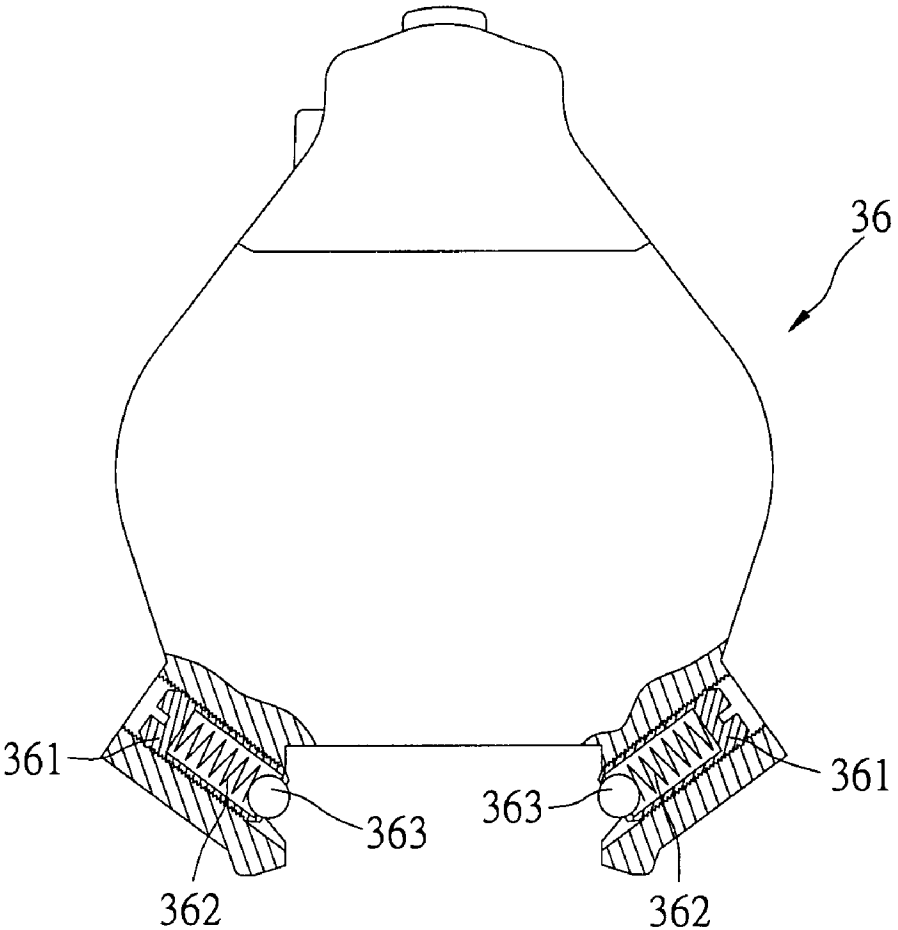
FIG. 8 is a cutaway view diagram illustrating the tactical flashlight and/or laser of the present invention.

Two sides of the elastic means 33 abut against the abutting portions 322 of the two control buttons 32 and the control buttons 32 are thereby moved outward. The lift portions 323 of the two control buttons 32 correspond to the bottom of the two oblique notches 341 on the movable tenon 34 (as shown in FIG. 6). Therefore, the lift portions 323 of the two control buttons 32 can push the oblique notches 341 of the movable tenon 34 to keep the movable tenon 34 lifting in a general state (i.e. the two control buttons 32 are not pressed).

After the above control buttons 32, elastic means 33 and movable tenon 34 are assembled with the chassis 31, so that the repressed board 38 and the board 36 covers the movable tenon 34, the control buttons 32 and the elastic means 33 for preventing the movable tenon 34, the control buttons 32 and the elastic means 33 from exposure outside or getting out, as well as providing shielding and dust-proofing, for example.

The bottom of the barrel 21 of the gun 2 is fixed with a mounting mortise 37. The mounting mortise 37 is laterally disposed along the barrel 21. When the tactical flashlight and/or laser 1 uses the first slideway 312 to engage with the second slideway 35 of the barrel 21 of the gun 2 for fixing, the movable tenon 34 keeps lifting in a general state. Hence, while the movable tenon 34 corresponding to the mounting mortise 37 on the bottom of the barrel 21 of the gun 2, the movable tenon 34 is engaged with the mounting mortise 37 so that the tactical flashlight and/or laser 1 can be fixed on the barrel 21 of the gun 2. Therefore, the tactical flashlight and/or laser 1 can be quickly mounted on the gun 2.

Figure 3:
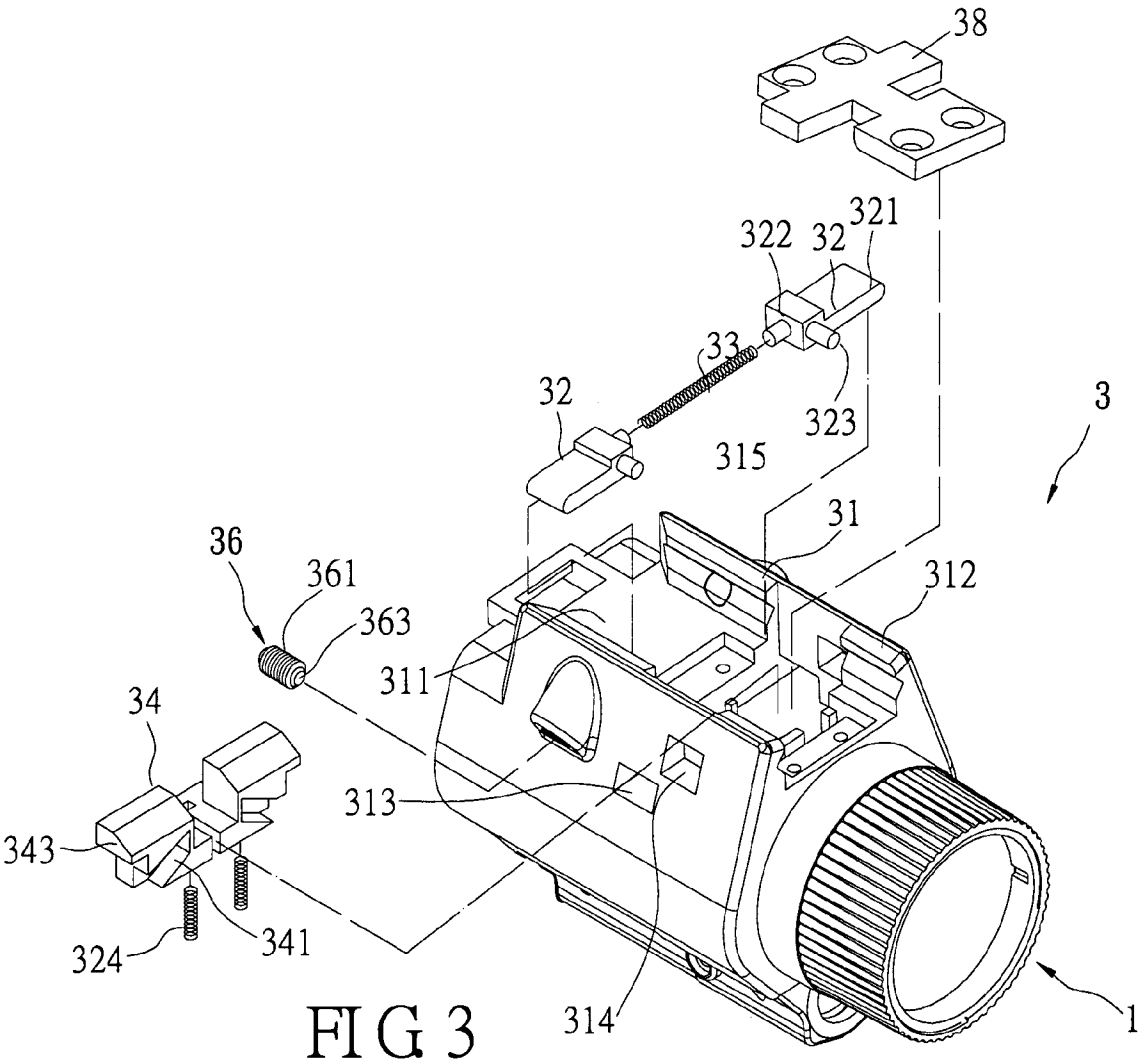
FIG. 3 is a three-dimensional exploded view illustrating the present invention.
Figure 4:
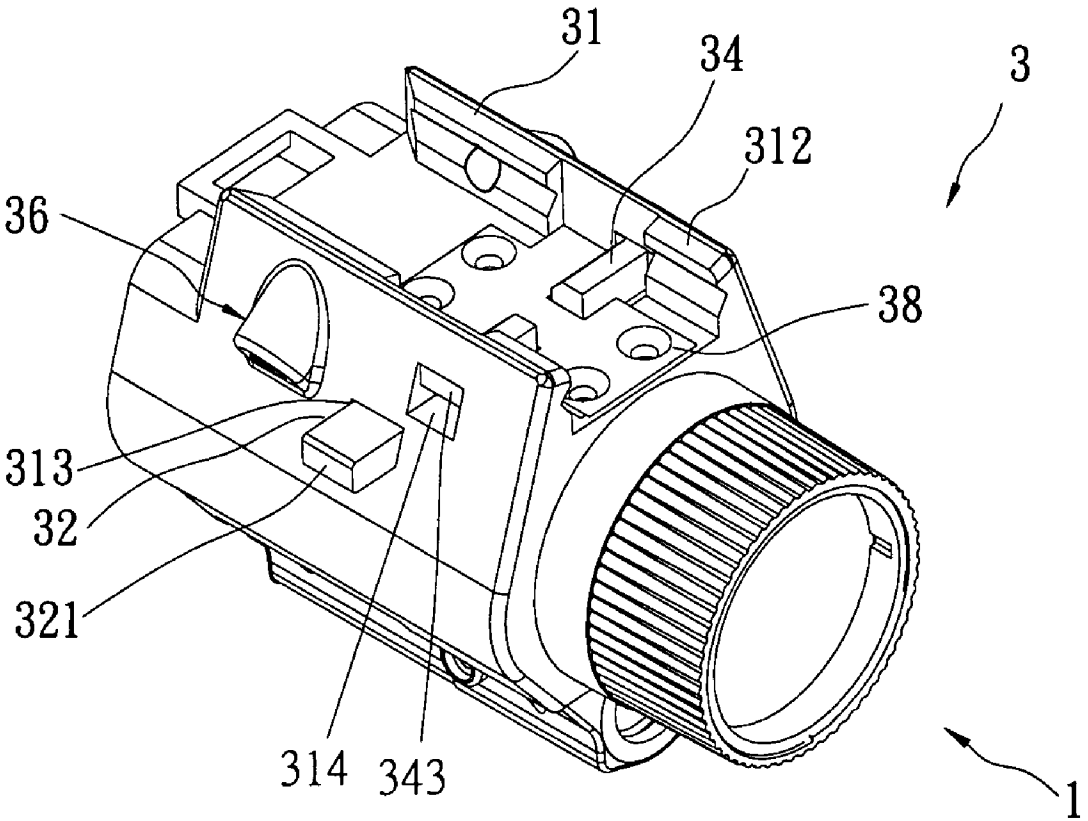
FIG. 4 is a three-dimensional diagram illustrating the present invention.
Figure 5:
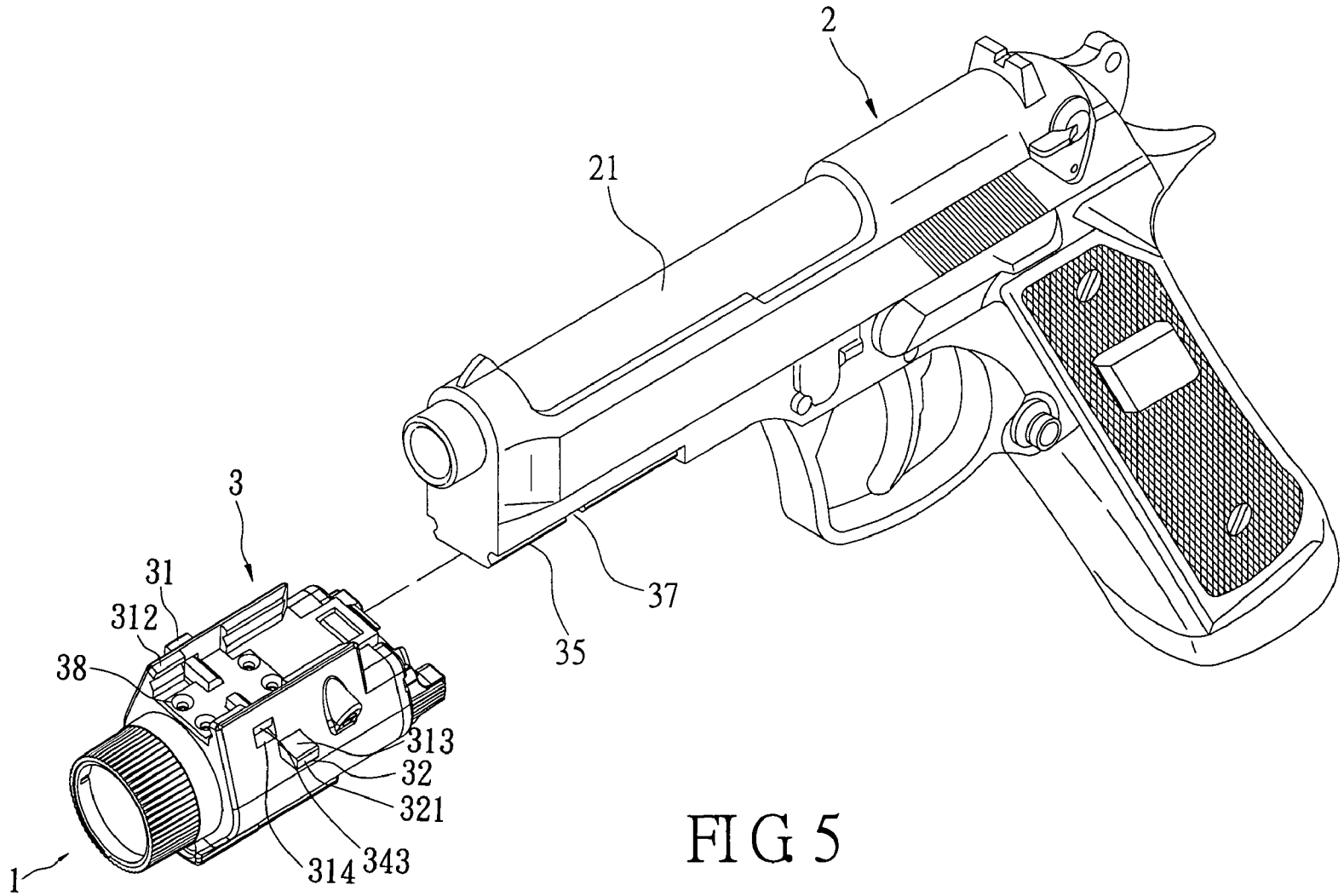
FIG. 5 is a three-dimensional diagram illustrating the tactical flashlight and/or laser of the present invention mounted on a gun.
Figure 7:
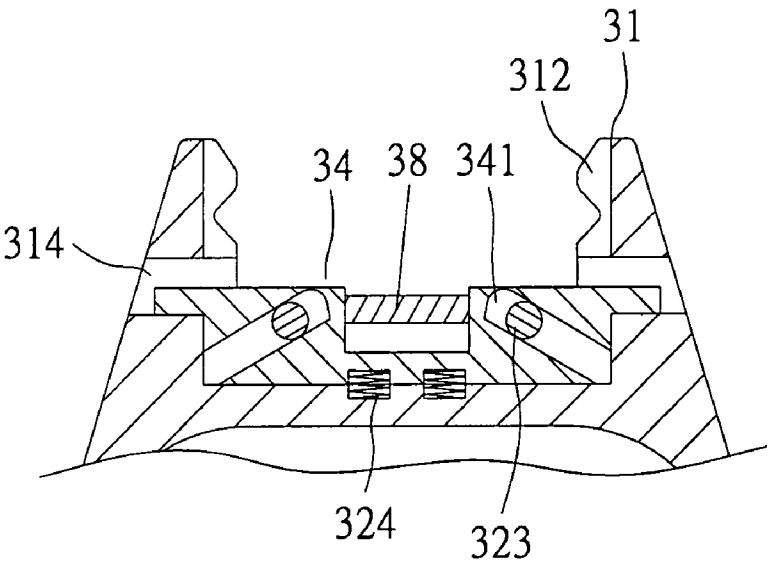
FIG. 7 is a schematic diagram illustrating an operating mode (2) of the tactical flashlight and/or laser of the present invention mounted on a gun.

Additionally, as shown in FIG. 7, the tactical flashlight and/or laser 1 is detached from the gun 2, by just pressing the pressing portions 321 of the two control buttons 32 (as FIG. 3). The control buttons 32 then move inward; at this time, the lift portions 323 of the control buttons 32 is slid up in the two oblique notches 341 and correspond to the oblique notches 341 on the bottom surface of the movable tenon 34, the movable tenon 34 falls down due to the lift portions 323 pushed. Therefore, the movable tenon 34 departs from the mounting mortise 37 so that the tactical flashlight and/or laser 1 are fast quickly detached from the barrel 21 of the gun 2.

Therefore, the present invention can use the mount structure 3 to quickly mount the tactical flashlight and/or laser 1 to the gun 2 and detach the tactical flashlight and/or laser 1 from the gun 2 without use of any fixing means, such as screws and nuts. The present invention is simply and easily operated without wasting time and effort and can achieve the objection for fast assembling and disassembling.

Given the above, the present invention does improve the conventional tactical flashlight and/or laser mount structure that screws the tactical flashlight and/or laser to the gun and wastes time and effort. The conventional tactical flashlight and/or laser mount structure causes inconvenience during mounting and removal and thus cannot achieve the objection for fast mounting and removal of a tactical flashlight and/or laser. Therefore, the present invention really belongs to a new model product with industrial applicability, novelty and inventive step and completely meets the applied element of a new model patent. The applicant has applied for the present invention according to the Patent Law and the subject application should be examined in detail and granted a patent right to protect the inventor's right.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and tactical flashlight and/or laser of the appended claims which are to be accorded with the broadest interpretation so as to encompass all such modifications and similar structures.

The invention claimed is:

1. A tactical flashlight and/or laser mount structure for mounting a tactical flashlight and/or laser on a gun, comprising:

a chassis disposed on the tactical flashlight and/or laser and connected separately to the gun;

two control buttons, each having a lift portion, the two control buttons being outward- and inward-movably disposed on the chassis;

an elastic means disposed between the two control buttons;

a movable tenon upward- and downward-movably disposed on the chassis and formed with two oblique notches, the lift portions of the control buttons selectively corresponding to two oblique notches, the movable tenon supported the least one spring above the chassis; and a mounting mortise fixed on the gun, wherein when the lift portions of the control buttons correspond to the bottom of the oblique notches of the movable tenon, the movable tenon is lifted to join with the mounting mortise for mounting the tactical flashlight and/or laser on the gun.

2. The tactical flashlight and/or laser mount structure of claim 1, wherein the chassis is fixed on a top of the tactical flashlight and/or laser.

3. The tactical flashlight and/or laser mount structure of claim 1, wherein the chassis is recessed with a space, and the control buttons, elastic means, and movable tenon are disposed therein.

4. The tactical flashlight and/or laser mount structure of claim 3, wherein the chassis has two first assembling aperture disposed on two sides of the space, and the two control buttons are respectively slidably matched in the two first assembling apertures of the chassis.

5. The tactical flashlight and/or laser mount structure of claim 3, wherein each of two sides of the space is disposed with a second assembling aperture, two ends of the movable tenon are respectively disposed with a sliding portion, and a position of the sliding portions of two ends of the movable tenon is lower than that of the second sliding portion, thereby making the sliding portions of the two ends of the movable tenon upward-slidingly and downward-slidingly matched in the second apertures of the chassis.

6. The tactical flashlight and/or laser mount structure of claim 1, wherein the chassis is disposed with a pair of first slide ways, the chassis uses the pair of first slide ways to engage with a pair of second slide ways corresponding to a barrel of the gun, and the pair of second slide ways is disposed along a vertical direction of the gun.

7. The tactical flashlight and/or laser mount structure of claim 1, wherein the control buttons and the elastic means are covered with a repressed board.

8. The tactical flashlight and/or laser mount structure of claim 1, wherein each of the control buttons comprises a pressing portion, the lift portions are connected to the pressing portions, each of the pressing portions further connects to an abutting portion, and two ends of the elastic means abut against the abutting portions of the control buttons.

9. The tactical flashlight and/or laser mount structure of claim 1, wherein the elastic means is a spring.

10. The gun tactical flashlight and/or laser mount structure of claim 1, wherein the oblique notches are oblique channels that its inside is rose to the outside.

11. The gun tactical flashlight and/or laser mount structure of claim 1, wherein the mounting mortise is disposed at a bottom of a barrel of the gun along a lateral direction of the barrel.

12. The gun tactical flashlight and/or laser mount structure of claim 2, wherein the chassis is having at least one fixed portion device, the fixed portion device is touched to the gun.

13. The gun tactical flashlight and/or laser mount structure of claim 12, wherein the fixed portion device is including: a fixed sleeve, a spring and a fixed portion ball, the fixed sleeve being fixed to the chassis, the spring and fixed portion ball of the fixed portion device being disposed in the fixed sleeve, and the spring of the fixed portion device being touched the fixed portion ball for the fixed portion ball touching to the gun.

* * * * *